United States Patent [19]

Sickles

[11] 4,266,721

[45] May 12, 1981

[54] SPRAY APPLICATION OF COATING COMPOSITIONS UTILIZING INDUCTION AND CORONA CHARGING MEANS

[75] Inventor: James E. Sickles, Glenshaw, Pa.

[73] Assignee: PPG Industries, Inc., Pittsburgh, Pa.

[21] Appl. No.: 75,933

[22] Filed: Sep. 17, 1979

[51] Int. Cl.[3] ..... B05B 5/02

[52] U.S. Cl. ..... 239/3; 239/707

[58] Field of Search ..... 239/3, 690–708, 239/456, 505, 506, 518, 524; 361/228

[56] References Cited

U.S. PATENT DOCUMENTS

| | | | |
|---|---|---|---|
| 2,302,185 | 11/1942 | Campbell, Jr. | 239/707 |
| 4,009,829 | 3/1977 | Sickles | 239/705 |
| 4,106,697 | 8/1978 | Sickles et al. | 239/705 |

FOREIGN PATENT DOCUMENTS

| | | | |
|---|---|---|---|
| 336173 | 10/1930 | United Kingdom | 239/456 |
| 1507561 | 4/1978 | United Kingdom . | |
| 1507562 | 4/1978 | United Kingdom . | |

*Primary Examiner*—Andres Kashnikow
*Attorney, Agent, or Firm*—George D. Morris

[57] ABSTRACT

Disclosed is a spray gun having a gas nozzle and a fluid nozzle, each of the nozzles being in cooperative spatial relationship with the other to cause a fluid stream issuing from the fluid nozzle to be atomized and sprayed as fluid particles by gas issuing from the gas nozzle. In a preferred embodiment the fluid nozzle orifice has therein an axially disposed rod to increase surface area from which the fluid particles can be found, the rod being a corona discharge electrode of a first polarity. The spray gun additionally has an induction charging electrode of a second polarity opposite the first polarity and disposed adjacent the gas and fluid nozzles, the induction charging electrode defining a charging zone wherein an electrostatic charge is imparted to atomized electrically-chargeable fluid particles. Relatedly disclosed is a method of applying a liquid coating composition having an electrical conductivity of less than about 0.06 μmho/cm to a workpiece through utilization of both corona and induction charging in a spray gun.

4 Claims, 8 Drawing Figures

FIG. 1
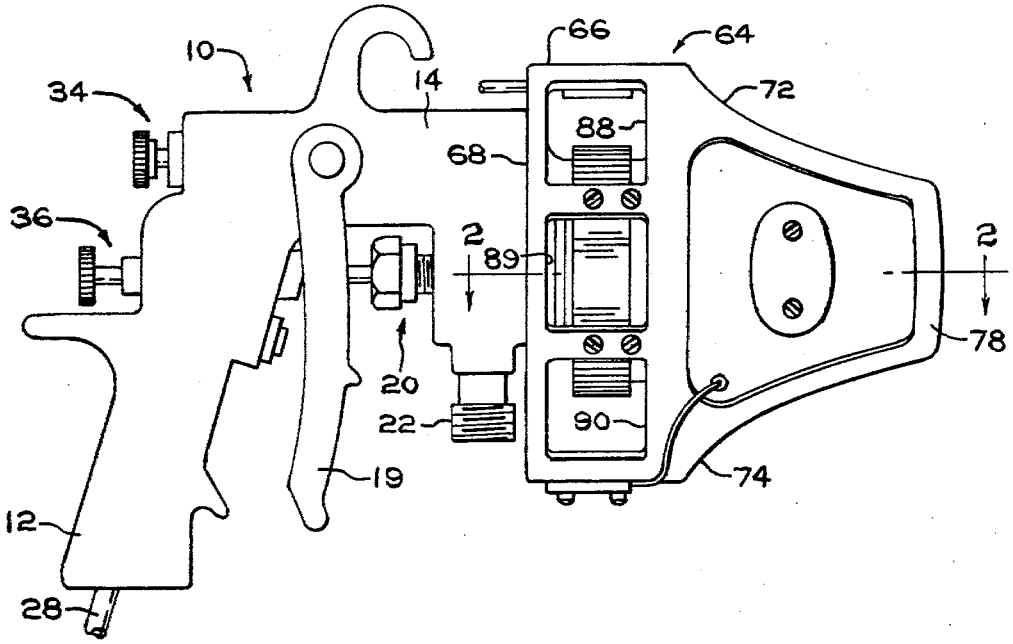
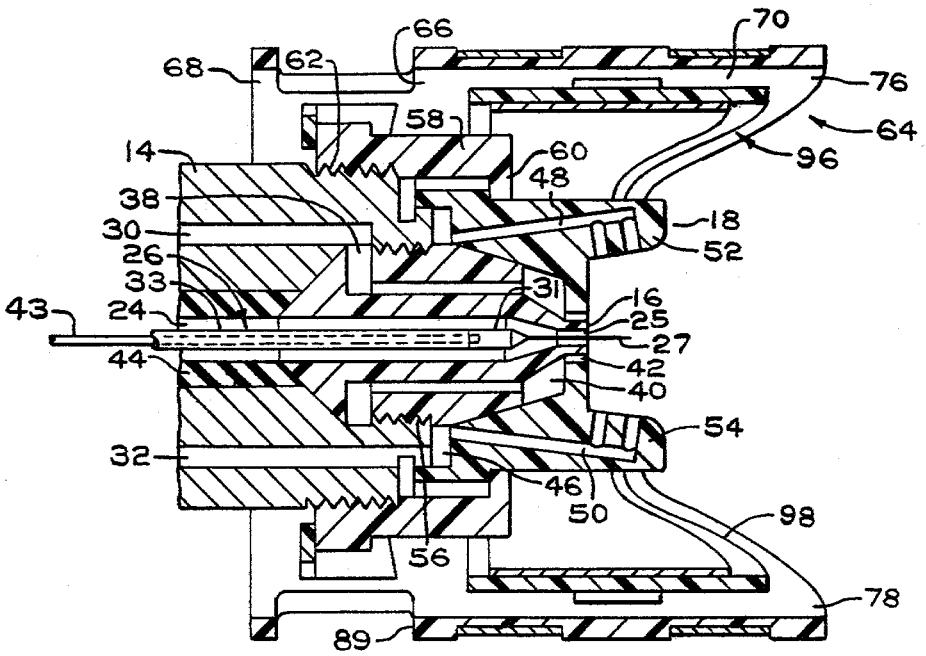
FIG. 2

FIG. 5
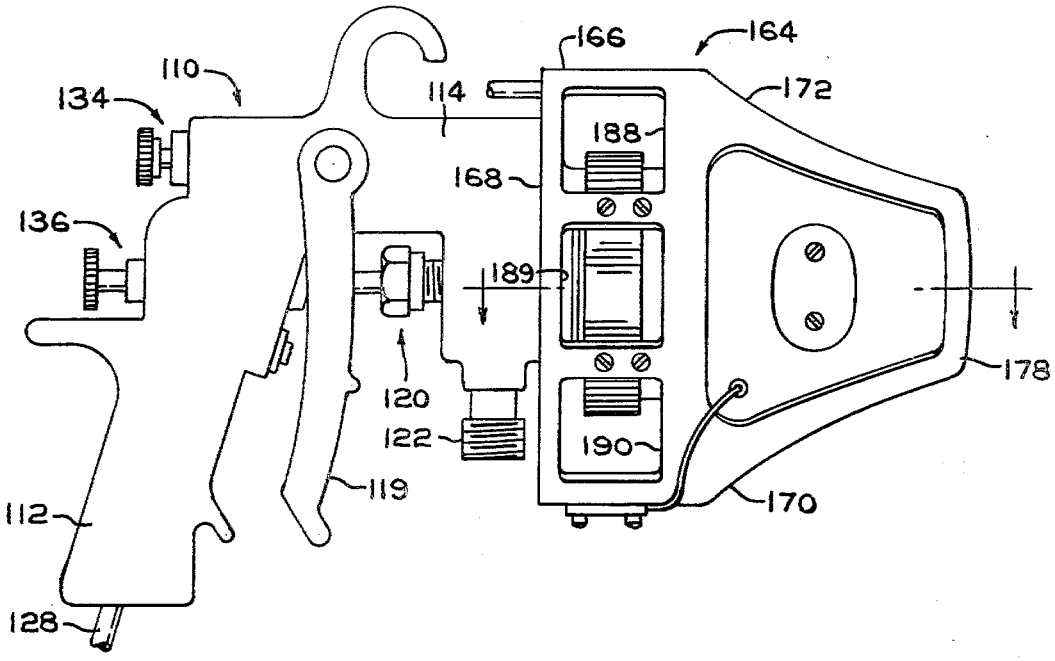
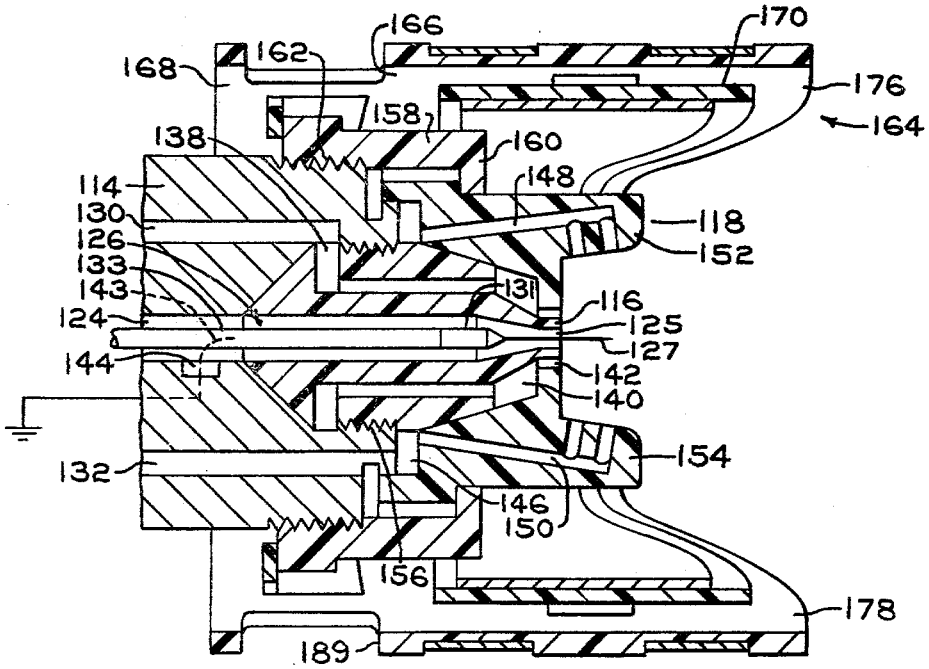
FIG. 6

SPRAY APPLICATION OF COATING COMPOSITIONS UTILIZING INDUCTION AND CORONA CHARGING MEANS

BACKGROUND OF THE INVENTION

Gas atomization of a fluid such as a paint composition to break up the fluid into particles for subsequent application to a workpiece to be coated is a technique well recognized in the art. Spray apparatus generally employed is a spray gun to which is supplied a fluid stream and a gas stream. The gas is most usually air, but can, of course, be chosen from other gases as required. The fluid stream issues from the spray gun via a fluid nozzle while the gas stream issues via a gas nozzle, with the gas stream intersecting or otherwise disturbing the fluid stream to provide atomized sprayed fluid particles.

To improve coating characteristics of the fluid particles issuing from the spray gun, various techniques have been developed to electrostatically impart an electrical charge to these particles prior to their arrival on the workpiece to be coated. One such technique is induction charging. Briefly, and in relation to the instant invention, a method of inducing an electrical charge on sprayed fluid particles involves the placement of an induction charging electrode means adjacent the fluid and gas nozzles. This electrode means induces an electrical charge on the atomized fluid particles, which charge is opposite to the electrode's charge, as the particles pass within a charging zone created between the electrode means and the particle stream. The electrode means itself can be an integral fixture of the spray gun, or it can be removably connected to the spray gun. An example of the latter electrode means which can be fitted to a conventional spray gun is described in U.S. Pat. No. 4,009,829, to James E. Sickles, incorporated herein by reference.

A second technique for imparting an electrostatic charge to fluid particles is corona charging. In this technique a needle-like electrode is disposed in the stream of fluid prior to atomization of the fluid into particles. The electrode discharges an electrical charge which is held by the fluid, with the subsequently formed fluid particles thus having a charge of the same polarity as that of the corona electrode. Voltage requirements in a corona charging system are, however, relatively high, generally 50 to 60 KV, and therefore create possible safety and energy-consumption disadvantages.

Copending application Ser. No. 076,014, filed on even date herewith and entitled "Electrostatic Spray Gun Having Increased Surface Area From Which Fluid Particles Can Be Formed," discloses a spray gun having disposed within the fluid stream means for increasing surface area from which fluid particles can be formed, said means being electrically grounded at least during fluid issue from the nozzle. Said spray gun has electrostatic charging means comprising an induction charging electrode means disposed adjacent the gas and fluid nozzles to create a charging zone wherein an electrical charge is induced on formed fluid particles. As related in said copending application, the surface area increasing means acts to provide a surface area for fluid particles issuing from the fluid nozzle orifice to be better exposed to the charging zone, and, because said means is grounded, to create a favorable potential gradient between the fluid particles and the electrode. Charging of the fluid particles therein described is solely accomplished by induction charging. It is known, however, that some fluids have a relatively medium-to-low electrical conductivity, generally defined as below about 0.06 μmho/cm. It is also known that a spray stream contains fluid particles whose sizes cover a range from large to small. Further, it has been found that larger particles having such medium-to-low electrical conductivity are not as well charged with induction charging as are those particles whose electrical conductivity exceeds about 0.06 μmho/cm. Smaller particles having medium-to-low electrical conductivity are, however, adequately charged to high charge-to-mass ratios. Conversely, it has been found that said larger particles do obtain adequate charging from a corona discharge means, while the smaller particles do not find optimum benefits with corona charging.

SUMMARY OF THE INVENTION

The subject of the invention disclosed and claimed herein is a spray gun having a gas nozzle and a fluid nozzle, each of said nozzles being in cooperative spatial relationship with the other to cause a fluid stream issuing from the fluid nozzle to be atomized and sprayed as fluid particles by gas issuing from the gas nozzle, with said spray gun having disposed within the fluid stream means for increasing surface area from which said particles can be formed, said means having at least one sharp edge and also being a powdered corona discharge electrode of a first polarity, and with said spray gun additionally having induction charging electrode means of a second polarity opposite the first polarity and disposed adjacent the gas and fluid nozzles, said induction charging electrode means defining a charging zone wherein an electrostatic charge is imparted to atomized electrically chargeable fluid particles. By providing the surface area increasing means, forming fluid particles are afforded greater exposure to the electrostatic field.

In a preferred embodiment, the means for increasing surface area comprises an axially disposed sharply pointed rod within the orifice of the fluid nozzle and protruding forwardly therefrom. Examples of other surface area increasing means include one or more tubes, one or more screw-thread rods, multiple pointed rods, one or more rods with various geometries such as an inverse cone distally and the like, with the proviso that said surface area increasing means must have adequately sharp or pointed configurations in order to effect corona discharge. The means can be disposed within the fluid nozzle orifice, or can be otherwise mounted so long as said means resides within the fluid stream.

The induction charging electrode means can be an integral fixture of the spray gun or it can be removably connected to said spray gun. As earlier recited, the induction charging electrode means imparts a charge on particles which is opposite in polarity to that of said electrode means. Conversely, the corona electrode imparts a charge on fluid particles which is of the same polarity as the corona electrode. As a result, surprisingly significant enhancement of coating deposition efficiency occurs due to improved charge distribution on the particles when the induction charging electrode means and the corona electrode are of opposite polarity. This effect is particularly advantageous where fluid of medium-to-low electrical conductivity (from about 0.005 to about 0.06 μmho/cm) is being employed since the magnitude of charging obtainable on a fluid particle by induction charging is directly related to the particle's electrical conductivity and physical size. Hence, while larger fluid particles of a medium-to-low conductivity fluid cannot fully benefit from induction charging alone, the addition of corona charging results in further charging of said fluid to produce a more fully charged fluid spray. Further, the total voltage requirement need not exceed that used in induction charging alone, said requirement generally being considerably lower than that required when only corona charging is employed.

Relatedly disclosed is a method of applying a sprayable liquid coating composition to a workpiece, said composition having an electrical conductivity between about 0.005 and about 0.06 μmho/cm, said method comprising spraying the composition by employing a spray gun having a gas nozzle and a fluid nozzle, each of the nozzles being in cooperative spatial relationship with each other to cause a fluid stream of the composition issuing from the fluid nozzle to be atomized and sprayed as fluid particles by gas issuing from the gas nozzle, (b) electrically grounded means for increasing surface area from which fluid particles can be formed, such means being disposed within the fluid stream and having at least one sharp edge, and (c) induction charging electrode means disposed adjacent the gas and fluid nozzles and having a rear edge located rearward of a plane which is perpendicular to the axis of liquid flow and which passes through the discharge point of the fluid nozzle; the method further comprising supplying sufficient voltage to the induction charging electrode means to produce a corona discharge at the sharp edge of the surface area increasing means, the method producing corona charging and induction charging of sprayed fluid particles.

In a preferred embodiment, the means for increasing surface area comprises an axially disposed pointed rod within the orifice of the fluid nozzle of the spray gun and protruding forwardly from said fluid nozzle. Examples of other surface area increasing means include one or more tubes, one or more screw-thread rods, multiple pointed rods, one or more rods with various geometries such as an inverse cone distally, and the like, with the proviso that said surface area increasing means must have adequately sharp or pointed configurations in order to effect corona discharge when liquid is being atomized. The means can be disposed within the fluid nozzle orifice, or can be otherwise mounted so long as said means resides within the fluid stream.

Although the invention is described and exemplified more fully in the following description and accompanying drawings, it is to be understood that this description and these drawings are not intended to limit the scope of the invention, but rather that the invention shall be defined as set forth in the appended claims.

BRIEF DESCRIPTION OF THE DRAWINGS

FIG. 1 is a side elevation view of a spray gun, shown in diagrammatic form, to which is connected an adapter bearing induction charging electrode means;

FIG. 2 is a partial sectional view of the spray gun and induction charging electrode means taken along line 2—2 of FIG. 1, additionally showing the needle of a needle valve assembly and a coaxially disposed corona electrode rod within the orifice of the fluid nozzle;

FIG. 5 is a side elevation view of a spray gun, shown in diagrammatic form, to which is connected an adapter bearing induction charging electrode means;

FIG. 6 is a partial sectional view of the spray gun and induction charging electrode means taken along line 6—6 of FIG. 5, additionally showing the needle of a needle valve assembly and a coaxially disposed rod within the orifice of the fluid nozzle;

DESCRIPTION OF PREFERRED EMBODIMENTS

Figure 3:
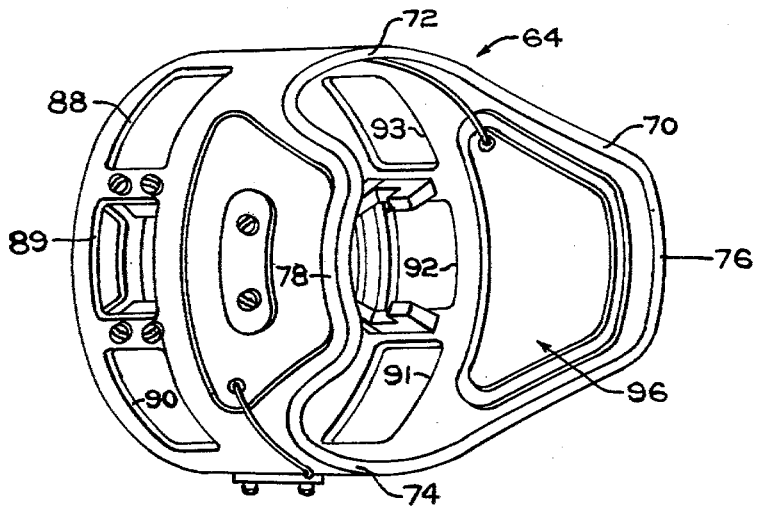
FIG. 3 is a perspective view of the adapter of FIG. 1.

Referring to FIGS. 1 and 2 of the drawings, a conventional hand-held, air-operated spray gun 10 is illustrated, said spray gun 10 having a handle portion 12, a barrel 14, a fluid nozzle 16 and a gas (air) nozzle 18, the latter two elements shown in FIG. 2. The spray gun 10 has a conventional trigger mechanism 19 which operates valve means 20 comprising a needle valve assembly to admit fluid from a supply source (not shown) to the spray gun 10. The fluid is fed to the spray gun 10 through a suitable connector 22 threadably connectable to a corresponding connector on a fluid feed hose (not shown) from the fluid supply. The fluid to be sprayed passes through the valve means 20 and flows through a fluid passageway 24 to the orifice 25 of the fluid nozzle 16. The needle 26 of the needle valve assembly moves axially in concert with movement of the trigger mechanism 19 to control fluid flow through the fluid nozzle orifice 25. In the embodiment shown in FIG. 2, a corona electrode rod 27 extends forwardly from the tip of the needle 26 to be axially disposed within the fluid nozzle orifice 25 and protrudes forwardly from said fluid nozzle orifice 25.

Air or another suitable gas is applied under pressure to the gas nozzle 18 by way of an air hose 28 and through suitable passageways in the body of the spray gun 10. The gas supply is divided into two separate passageways 30 and 32, with gas flow being regulated by a manually adjustable control valve generally indicated at 34. A second control valve 36 permits adjustment of the needle 26 in passageway 24, in a manner as known in the art. The gas flow in one of the passageways, for example passageway 30, is directed to an annular chamber 38 from which the gas flows forward to a second annular chamber 40. The gas nozzle 18 incorporates a plurality of orifices such as an annulus 42 surrounding the fluid nozzle orifice 25, which serve to direct gas from chamber 40 to shape the flow of fluid from the fluid nozzle orifice 25 in known manner. The flow of gas from passageway 32 is directed to an annular chamber 46 which is in communication with passageways 48 and 50 leading to orifices disposed in diametrically opposed ears 52 and 54 of the gas nozzle 18. Gas flowing from the orifices in the ears 52 and 54 serve to direct gas toward the atomized fluid being discharged from fluid nozzle orifice 25 and thereby shape the pattern of the spray.

In the instant embodiment the fluid nozzle 16 and gas nozzle 18 are constructed of a dielectric or electrically non-conductive material. The fluid nozzle 16 can be secured in the barrel 14 of the spray gun 10 by any suitable means, as by threads 56. Similarly, the gas nozzle 18 is secured to the barrel 14 by suitable means such as an annular nut 58 having an inner shoulder portion 60 which engages a corresponding shoulder on the gas nozzle 18 and which is threaded onto the exterior of the barrel 14 by means of threads 62. Fluid being supplied is electrically grounded, preferably at its source of supply, in order to insure proper induction charging. The fluid passageway 24 has a dielectric wall 44 to prevent current flow from the corona electrode rod 27 to the metal body of the spray gun barrel 14.

Mounted on the exterior of the barrel 14 and concentric with the fluid nozzle orifice 25 is an induction charging adapter 64 bearing induction charging electrode means. U.S. Pat. No. 4,009,829, to James E. Sickles, fully describes the adapter 64, and said patent is included herein and made a part hereof by reference. As described and exemplified as a preferred embodiment in said patent and as illustrated in FIGS. 1 and 3 hereof, the adapter is essentially a cylindrical housing 66 formed of a dielectric material and having a rearward portion 68 adapted to be secured to the spray gun and a forwardly extending portion 70 adapted to surround the path of the discharged spray material. Diametrically opposed portions of the forward part of the dielectric housing 66 are cut away at 72 and 74 (See FIG. 3), leaving shaped, forwardly extending, opposed lobes 76 and 78 remaining. The lobes 76 and 78 carry charging electrodes, for which a d.c. voltage is applied for inductively charging the spray particles, while the cutaway portions 72 and 74 prevent interference by the housing 66 with generally fanshaped patterns which may be produced in the spray, and assist in the aspiration of ambient air through the housing 66. Again, it will be understood that the dielectric housing may be constructed of any suitable material capable of withstanding the high voltages used, and in particular can be constructed of materials including acetal resins, epoxy resins, glass-filled epoxy resins, or the like. The adapter 64 is attached to the end of spray gun 10 by means of suitable mounts which are shaped to engage the outer surface of the barrel or of the annular nut 58. Although the exact shape of the mounts will depend upon the construction of the particular barrel to which the adapter is to be connected, the mounts in general are formed to secure the adapter in concentric relationship with the fluid nozzle orifice 25. Again, reference should be made to U.S. Pat. No. 4,009,829 in regard to mounting configurations.

The electrostatic field by means of which the adapter 64 produces induction charging of the atomized fluid particles is generated by means of a pair of charging electrodes 96 and 98. These electrodes are mounted to the inner surfaces of lobes 76 and 78, respectively, of the adapter and thus are positioned on diametrically opposite sides of the fluid and air nozzles. The electrodes are spaced from the fluid nozzle and are concentric therewith, having curved surfaces which are equidistant from the longitudinal axis of the fluid nozzle 16. A high positive or negative voltage is supplied to the two opposed electrodes 96 and 98, and this voltage produces an electrostatic field between the electrodes, the fluid spray discharged from the spray gun, and the protruding rod. This field defines a charging zone within the adapter which serves to induce an opposite charge on any particulate fluids passing therethrough. The voltage can vary over a wide range, but preferably is less than about 30 kilovolts. The magnitude of the voltage required to achieve optimum charging efficiency depends upon the radial distance between the surfaces of the electrodes and the axis of the liquid flow, on the longitudinal, or axial location of the adapter with respect to a plane perpendicular to the axis of the adapter and passing through the discharge point of the fluid nozzle, on the rates of air and liquid flow from the nozzle, and the like. Thus, as the induction charging electrodes are moved radially outwardly from the axis of the liquid flow, higher voltages are required to achieve the optimum charging efficiency.

It has been found that optimum results are obtained when the average potential gradient within the charging zone, between the charging electrodes and the fluid nozzle, is between about 5 and about 30 kilovolts per inch. While the preferred embodiment described herein utilizes induction charging electrode means removably connected to the spray gun, it is to be understood that such electrode means can also be an integral fixture of the spray gun.

Returning to FIGS. 2 and 4, the corona electrode rod 27 in the embodiment shown protrudes forwardly from the tip of the needle 26 and extends forward of the fluid nozzle orifice 25. The rod 27 in the embodiment shown is disposed within the shaft of the needle 26 to protrude forwardly from a forward orifice 29 in said needle 26.

Diameter of the rod in relation to diameter of the fluid nozzle orifice can be selected as required in respect to viscosity of fluid being sprayed, fluid flow rate desired, and the like. Generally, the diameter of the rod will be between about 20 percent and about 70 percent of the diameter of the fluid nozzle orifice.

Figure 4:
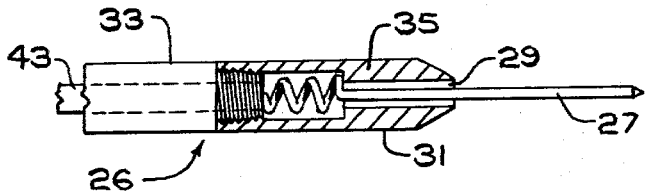
FIG. 4 is an exploded partial sectional view of the needle and corona electrode rod of FIG. 2.

As is shown in FIG. 4, the rod 27 is secured within the needle 26 by means of a needle tip 31 having an orifice 29 through which the rod 27 extends, with said needle tip 31 threadably securable to the shaft portion 33 of the needle 26. The rearward end of the rod 27 is spiraled and abuts the shaft portion 33 to be held in place with tension against the rear of orifice wall 35. When the spray gun 10 is in operation, the rod 27 must protrude forwardly from the fluid nozzle orifice 25 and can protrude into the charging zone of the electrodes 96,98. Connection wires within a cable 43 lead from a power source (not shown) to the rod 27. Said cable 43 is threaded through the hollow interior of the needle 26, and carries electrical current to said rod 27. In operation, suitable voltage is supplied to the rod 27 as required for maximum electrostatic charging of the particular fluid being sprayed without effecting arcing or sparking between the induction charging and corona electrodes. The tip of the rod 27 is preferably formed to a very sharp point or edge to assure maximum corona discharge. As earlier recited, a medium-to-low conductivity fluid, such as a paint composition having a high solids content, benefits greatly in regard to magnitude of charging when both corona and induction charging occurs since larger particles thereof are more readily charged by corona discharge while smaller particles thereof are more readily charged by induction.

Referring to FIGS. 5 and 6 of the drawings, a conventional hand-held, air-operated spray gun 110 is illustrated, said spray gun 110 having a handle portion 112, a barrel 114, a fluid nozzle 116 and a gas (air) nozzle 118, the latter two elements shown in FIG. 6. The spray gun 110 has a conventional trigger mechanism 119 which operates valve means 120 comprising a needle valve assembly to admit fluid from a supply source (not shown) to the spray gun 110. The fluid is fed to the spray gun 110 through a suitable connector 122 threadably connectable to a corresponding connector on a fluid feed hose (not shown) from the fluid supply. The fluid to be sprayed passes through the valve means 120 and flows through a fluid passageway 124 to the orifice 125 of the fluid nozzle 116. The needle 126 of the needle valve assembly moves axially in concert with movement of the trigger mechanism 119 to control fluid flow through the fluid nozzle orifice 125. In the embodiment shown in FIG. 6, a rod 127 extends forwardly from the tip of the needle 126 to be coaxially disposed within the fluid nozzle orifice 125 and protrudes forwardly from said fluid nozzle orifice 125.

Air or another suitable gas is applied under pressure to the gas nozzle 118 by way of an air hose 128 and through suitable passageways in the body of the spray gun 110. The gas supply is divided into two separate passageways 130 and 132, with gas flow being regulated by a manually adjustable control valve generally indicated at 134. A second control valve 136 permits adjustment of the needle 126 in passageway 124, in a manner as known in the art. The gas flow in one of the passageways, for example passageway 130, is directed to an annular chamber 138 from which the gas flows forward to a second annular chamber 140. The gas nozzle 118 incorporates a plurality of orifices such as an annulus 142 surrounding the fluid nozzle orifice 125, which serve to direct gas from chamber 140 to shape the flow of fluid from the fluid nozzle orifice 125 in known manner. The flow of gas from passageway 132 is directed to an annular chamber 146 which is in communication with passageways 148 and 150 leading to orifices disposed in diametrically opposed ears 152 and 154 of the gas nozzle 118. Gas flowing from the orifices in the ears 152 and 154 serve to direct gas toward the atomized fluid being discharged from fluid nozzle orifice 125 and thereby shape the pattern of the spray.

In the instant embodiment the fluid nozzle 116 is preferably constructed of metal, and is grounded through the fluid sprayed. Said nozzle 116 can also be grounded directly, or can be constructed of an electrically non-conductive or dielectric material. The gas nozzle 118 is constructed of an electrically non-conductive or dielectric material. The fluid nozzle 116 can be secured in the barrel 114 of the spray gun 110 by any suitable means, as by threads 156. Similarly, the gas nozzle 118 is secured to the barrel 114 by suitable means such as an annular nut 158 having an inner shoulder portion 160 which engages a corresponding shoulder on the gas nozzle 118 and which is threaded onto the exterior of the barrel 114 by means of threads 162. Fluid being supplied is electrically grounded, as by means of a ground plate 144, in order to insure proper induction charging.

Figure 7:
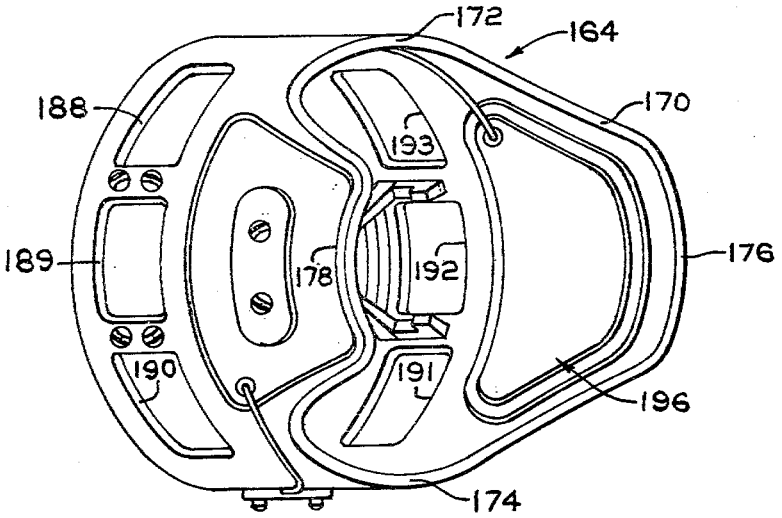
FIG. 7 is a perspective view of the adapter of FIG. 5.

Mounted on the exterior of the barrel 114 and concentric with the fluid nozzle orifice 125 is an induction charging adapter 164 bearing induction charging electrode means. U.S. Pat. No. 4,009,829, to James E. Sickles, fully describes the adapter 164, and said patent is included herein and made a part hereof by reference. As described and exemplified as a preferred embodiment in said patent and as illustrated in FIGS. 5 and 7 hereof, the adapter is essentially a cylindrical housing 166 formed of a dielectric material and having a rearward portion 168 adapted to be secured to the spray gun and a forwardly extending portion 170 adapted to surround the path of the discharged spray material. Diametrically opposed portions of the forward part of the dielectric housing 166 are cut away at 172 and 174 (see FIG. 7), leaving shaped, forwardly extending, opposed lobes 176 and 178 remaining. The lobes 176 and 178 carry charging electrodes, for which a d.c. voltage is applied for inductively charging the spray particles, while the cutaway portions 172 and 174 prevent interference by the housing 166 with generally fanshaped patterns which may be produced in the spray, and assist in the aspiration of ambient air through the housing 166. Again, it will be understood that the dielectric housing may be constructed of any suitable material capable of withstanding the high voltages used, and in particular can be constructed of materials including acetal resins, epoxy resins, glass-filled epoxy resins, or the like. The adapter 164 is attached to the end of spray gun 110 by means of suitable mounts which are shaped to engage the outer surface of the barrel or of the annular nut 158. Although the exact shape of the mounts will depend upon the construction of the particular barrel to which the adapter is to be connected, the mounts in general are formed to secure the adapter in concentric relationship with the fluid nozzle orifice 125. Again, reference should be made to U.S. Pat. No. 4,009,829 in regard to mounting configurations.

The electrostatic field by means of which the adapter 164 produces induction charging of the atomized fluid particles is generated by means of a pair of charging electrodes 196 and 198. These electrodes are mounted to the inner surfaces of lobes 176 and 178, respectively, of the adapter and thus are positioned on diametrically opposite sides of the fluid and air nozzles. The electrodes are spaced from the fluid nozzle and are concentric therewith, having curved surfaces which are equidistant from the longitudinal axis of the fluid nozzle 116. A high positive or negative voltage is supplied to the two opposed electrodes 196 and 198, and this voltage produces an electrostatic field between the electrodes and the electrically grounded fluid spray discharged from the spray gun. This field defines a charging zone within the adapter which serves to induce an opposite charge on any particulate fluids passing therethrough. The voltage can vary over a wide range, but preferably is less than about 30 kilovolts. The magnitude of the voltage required to achieve optimum charging efficiency depends upon the radial distance between the surfaces of the electrodes and the axis of the liquid flow, on the longitudinal, or axial location of the adapter with respect to a plane perpendicular to the axis of the adapter and passing through the discharge point of the fluid nozzle, on the rates of air and liquid flow from the nozzle, and the like. Thus, as the induction charging electrodes are moved radially outwardly from the axis of the liquid flow, higher voltages are required to achieve the optimum charging efficiency.

It has been found that optimum results are obtained when the average potential gradient within the charging zone, between the charging electrodes and the fluid nozzle, is between about 5 and about 30 kilovolts per inch. While the preferred embodiment described herein utilizes induction charging electrode means removably connected to the spray gun, it is to be understood that such electrode means can also be an integral fixture of the spray gun.

Returning to FIGS. 5 and 7, the rod 127 in the embodiment shown protrudes forwardly from the tip of the needle 126 and extends forward of the fluid nozzle orifice 125. The rod 127 in the embodiment shown is disposed within the shaft of the needle 126 to protrude forwardly from a forward orifice 129 in said needle 126. The rod 127 is electrically conductive and grounded with a connection wire 143 shown in broken line from the needle shaft to ground plate 144. Diameter of the rod in relation to diameter of the fluid nozzle orifice can be selected as required in respect to viscosity of fluid being sprayed, fluid flow rate desired, and the like. Generally, the diameter of the rod will be between about 20 percent and about 70 percent of the diameter of the fluid nozzle orifice, but can be greater or less depending upon actual fluid nozzle orifice diameter and physical characteristics of fluid being sprayed. Because the rod is electrically grounded during fluid issue, the fluid in contact with the rod is very near ground potential, thus providing a maximum potential gradient between the electrode means and the fluid particles or droplets entering the charging zone to thereby produce maximum droplet charging. Furthermore, it is found that the rod acts to provide more surface area from which particles can be formed, resulting in formation of a greater number of more uniformly-sized charged particles under the combined action of the shearing atomization air and the applied electric field. The maximum potential gradient discussed above, coupled with the greater tendency to produce uniformly-sized droplets, also acts to distribute the electrical charge more evenly on the droplets and thereby yield better deposition of fluid particles on the workpiece being coated, said workpiece being understood to be electrically receptive to the charged spray.

Figure 8:
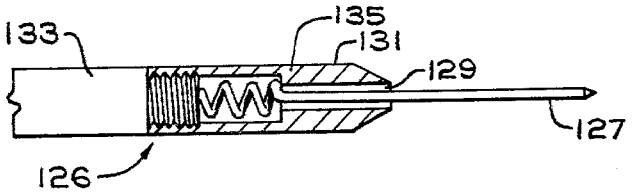
FIG. 8 is an exploded partial sectional view of the needle and rod of FIG. 6.

As is shown in FIG. 8, the rod 127 is secured within the needle 126 by means of a needle tip 131 having an orifice 129 through which the rod 127 extends, with said needle tip 131 threadedly securable to the shaft portion 133 of the needle 126. The rearward end of the rod 127 is spiraled and abuts the shaft portion 133 to be held in place with tension against the rear of orifice wall 135. When the spray gun 110 is in operation, the rod 127 must protrude forwardly from the fluid nozzle orifice 125 and can protrude into the charging zone of the electrodes 196,198.

As above described, the spray gun provides an electrostatic induction charging electrode which imparts an electrical charge to the sprayed particles substantially simultaneously with their formation, and further embodies a rod concentrically disposed within and protruding forwardly from the orifice of the fluid nozzle, said rod being electrically grounded as above described. It has suprisingly been found that, when a medium-to-low conductivity fluid is exposed to induction charging electrode means within a grounded pointed rod is also present in the stream of said fluid, a corona discharge can be effectuated off of the tip of said rod by increasing the induction charging electrode means' voltage above that voltage required for effective induction charging alone of said fluid. Thus, an increase in voltage causes the grounded pointed rod to operate as corona discharge electrode. The magnitude of voltage increase to the induction charging electrode means can range from that required for corona discharge to first occur to a value just below that which causes arcing or sparking between the induction charging electrode means and the pointed rod. This corona effect is particularly advantageous where medium-to-low conductivity fluid is sprayed since the magnitude of charging obtainable on such a fluid particle by induction charging is directly related to the fluid's electrical and physical parameters. While smaller particles of such a fluid can be more completely charged by the induction process, larger particles cannot. With the addition of corona discharge, however, these larger particles can also be more completely charged.

When fluid particles have an electrical conductivity above about 0.06 μmho/cm, it has been found that the above-related corona effect does not occur, thus surprisingly illustrating a heretofore unknown method of providing both corona and induction charging to a medium-to-low electrical conductivity liquid coating composition. Further, because the polarities of the charges imparted by both the corona and induction charging means are the same, no charge cancellation effect can occur.

The following Examples are incorporated herein to illustrate improved results in transfer efficiency to a workpiece being coated with a liquid coating composition having a medium-to-low electrical conductivity. Transfer efficiency (TE), reported as a percentage of coating composition deposited on a target in relation to the theoretical amount (100 percent) which could be deposited on said target is determined according to the following formula:

$$\% \, TE = \frac{\text{target speed (ft/min)} \times \text{gms. coating deposited} \times 100}{\text{coating flow (gms/min)} \times \text{target width (ft)} \times \text{\# passes} \times \text{solids (decimal fraction)}}$$

In the above calculation, the designation "target speed" refers to the speed at which the target is passed perpendicularly to the axis of the fluid nozzle of the spray gun. Weight of coating composition deposited is determined after drying. Coating composition flow is measured at the spray gun. The term "coating solids" is defined as the decimal fraction of weight solids. In the description which follows, all transfer efficiency values are determined according to the above formula. Targets utilized for measuring transfer efficiency in the Examples herein were constructed according to the following description. Each of five targets used in each measurement of transfer efficiency consisted of a pre-weighed aluminum foil about 6 inches (15.24 cm) wide, 36 inches (91.44 cm) long, and 0.0015 inch (0.0038 cm)thick. An electrically-grounded frame was provided, and the targets were mounted thereon in the following order. Two of the foil targets were mounted on a flat aluminum plate attached to the frame, thus providing two flat sheets. The remaining three foil targets were mounted on U-shape (when viewed from above) aluminum plates attached to the frame, thus providing three semi-tubular targets. The lateral sides of these targets were about $1\frac{3}{4}$ inches (4.45 cm), while the remaining portion (equivalent to the base of the U-shape) was about $1\frac{1}{8}$ inches (2.85 cm). Distance between the mid-points of said bases of the U-shape plates was 6 inches (15.24 cm). Finally, five tube-shaped (when viewed from above) aluminum foil targets, not involved in transfer efficiency measurements, were provided to the frame to make certain that electrical attraction of charged particles being sprayed toward the targets was not improperly concentrated toward the adjacent semi-tubular target which, but for the tube-shaped targets, would be the final target to be sprayed.

In the Examples which follow, a Binks Model 70 spray gun was utilized. The spray gun was equipped with a Binks Model N65 fluid nozzle and a center rod disposed within the nozzle orifice, was modified to be equipped with a Binks Model N63PB, air cap, and was fitted with the induction charging adapter of FIG. 3.

The spray gun was stationary and placed so that the targets were 12 inches (30.48 cm) from the face of the air cap. The frame upon which the targets were disposed was passed at a speed of 28 feet (8.53 m) per minute in front of the spray gun. For each set of measurements, four sets of two such passes were made while heated paint was being sprayed. The foils were then removed from the frame, baked for 20 minutes at 340 F., cooled to 70 F., and weighed to determine net paint deposition from which transfer efficiency was calculated. Paint flow rate is measured at the temperature at which the paint is sprayed.

EXAMPLE 1

A paint composition comprising the following components was prepared:

| | |
|---|---|
| Polyester resin (60% solids) [Polycron ® Appliance Finish Resin, PPG Industries, Inc.] | 35.31 lbs. (16.02 kg) |
| Dipropylene glycol methyl ester [Dowanol ® DPM, Dow Chemical Co.] | 18.83 lbs. (8.54 kg) |
| Polyethylene cuts [Pennsylvania Refining Co., #3012] | 3.01 lbs. (1.37 kg) |
| Rutile titanium dioxide | 144.53 lbs. (65.56 kg) |
| Combined with | |
| Hexamethoxy melamine resin [Resimene X-747 ®, Monsanto Co.] | 24.00 lbs. (10.89 kg) |
| Dipropylene glycol methyl ester [Dowanol ® DPM, Dow Chemical Co.] | 3.82 lbs. (1.73 kg) |
| Isobutanol | 4.20 lbs. (1.91 kg) |
| N-butyl acetate | 1.55 lbs. (703 g) |
| Combined with | |
| Superfine fumed silica [Cab-O-Sil ®, Cabot Corp.] | 2.00 lbs. (907 g) |
| Combined with | |
| Polyester resin (ester diol-isophthalate-90% in Cellosolve acetate) | 63.23 lbs. (28.68 kg) |
| Epoxy resin solution (25% in toluene) | 27.66 lbs. (12.55 kg) |
| Hexamethoxy melamine resin [Resimene X-747 ®, Monsanto Co.] | 28.61 lbs. (12.98 kg) |
| Cold pressed castor oil | 7.55 lbs. (3.43 kg) |
| 2-ethylhexyl acrylate homopolymer (62.5% solids in xylene-butanol solvent) | 0.47 lbs. (213 g) |
| Organosilicane surfactant [L-7500, Union Carbide Corp.] | 0.03 lbs. (13.6 g) |
| Combined with | |
| 40% para toluene sulfonic acid | 1.47 lbs. (667 g) |
| Carbon black tint | 0.07 lbs. (31.8 g) |

The paint composition had a delivery temperature of about 180° F. as measured at the butt of the spray gun, and was sprayed utilizing 35 psig atomizing air pressure, also measured at the gun butt, with transfer efficiency (TE) measurements made on flat sheets and on semi-tubular targets as above described. The temperature of the atmosphere (air) in which the targets were disposed and through which the spray travelled to said targets was 70° F. Conductivity of the paint composition at 180° F. was 0.041 μmho/cm; viscosity was 200 centipoise; solids content by weight was 80 percent. Table I shows results obtained.

TABLE I

| Voltage (KV) Positive Supplied to Induction Charging Electrode | Paint Temperature (F.) | Paint Flow Rate (gm/min) | % TE Flat Sheet | % TE Semi-Tubular |
|---|---|---|---|---|
| 18 | 179° | 199.6 | 59.6 | 17.2 |

EXAMPLE 2

The procedure of Example 1 was followed except for an increase in voltage supplied to the induction charging electrode. Table II shows results obtained.

TABLE II

| Voltage (KV) Positive Supplied to Induction Charging Electrode | Paint Temperature (F.) | Paint Flow Rate (gm/min) | % TE Flat Sheet | % TE Semi-Tubular |
|---|---|---|---|---|
| 22-23 | 182° | 200 | 71.1 | 31.0 |

As is evident from the above, essentially the same conditions in Example 1 as in Example 2 except for a voltage increase in the induction-charging electrode significantly increased transfer efficiency at both flat sheet and semi-tubular targets. It has been visually observed that utilization of the spray gun here employed, having a grounded rod concentrically disposed within its fluid nozzle orifice, in combination with a coating composition having a relatively low electrical conductivity causes a corona discharge to occur at the tip of said rod when the voltage of the induction charging electrode is increased above about 20 KV. It is believed that larger particles of the spray stream are better charged by said corona discharge while smaller particles of the stream are better charged by induction. While the paint composition exemplified in the above Examples was heated, it is to be understood that such heating is not required so long as the viscosity of the composition being sprayed is low enough to permit adequate sprayability of said composition.

Those skilled in the art will recognize that the inventive quanta of this application can be embodied in forms other than those specifically exemplified herein for purposes of illustration.

What is claimed is:

1. A method of applying a sprayable liquid coating composition to a workpiece, said composition having an electrical conductivity between about 0.005 and about 0.06 μmho/cm, said method comprising spraying said composition by employing a spray gun having:

(a) a gas nozzle and a fluid nozzle, each of said nozzles being in cooperative spatial relationship with each other to cause a fluid stream of said composition issuing from said fluid nozzle to be atomized and sprayed as fluid particles by gas issuing from said gas nozzle, (b) electrically grounded means for increasing surface area from which fluid particles can be formed, said means being disposed within said fluid stream and having at least one sharp edge, and (c) induction charging electrode means disposed adjacent said gas and fluid nozzles and having a rear edge located rearward of a plane which is perpendicular to the axis of liquid flow and which passes through the discharge point of said fluid nozzle;

said method further comprising supplying sufficient voltage to said induction charging electrode means to produce a corona discharge at said sharp edge of said surface area increasing means, said method producing corona charging and induction charging of sprayed fluid particles.

2. A method as claimed in claim 1 wherein the electrical conductivity of the liquid coating composition is from about 0.035 to about 0.045 μmho/cm.

3. A method as claimed in claim 1 wherein the liquid coating composition is a paint composition.

4. A method as claimed in claim 1 wherein the means for increasing surface area comprises an axially disposed pointed rod within the fluid nozzle orifice of the spray gun and protruding forwardly from said fluid nozzle.

* * * * *